US012371890B2

(12) United States Patent
Miller

(10) Patent No.: US 12,371,890 B2
(45) Date of Patent: Jul. 29, 2025

(54) LEACHING CHAMBER WITH LOCKING SWIVEL LATCH

(71) Applicant: ADVANCED DRAINAGE SYSTEMS, INC., Hilliard, OH (US)

(72) Inventor: Adam Miller, Haddam, CT (US)

(73) Assignee: ADVANCED DRAINAGE SYSTEMS, INC., Hilliard, OH (US)

( * ) Notice: Subject to any disclaimer, the term of this patent is extended or adjusted under 35 U.S.C. 154(b) by 126 days.

(21) Appl. No.: 18/333,772

(22) Filed: Jun. 13, 2023

(65) Prior Publication Data

US 2023/0407619 A1 Dec. 21, 2023

Related U.S. Application Data

(60) Provisional application No. 63/352,344, filed on Jun. 15, 2022.

(51) Int. Cl.
*E03F 1/00* (2006.01)
*E02B 11/00* (2006.01)

(52) U.S. Cl.
CPC ..... *E03F 1/003* (2013.01)

(58) Field of Classification Search
CPC .. E03F 1/002; E03F 1/003; E03F 3/04; E02B 11/005
See application file for complete search history.

(56) References Cited

U.S. PATENT DOCUMENTS 5,588,778 A * 12/1996 Nichols ..... E03F 1/003 405/48
6,375,388 B1 * 4/2002 Zoeller ..... E03F 1/003 405/44
6,592,293 B1 7/2003 Hedstrom et al.
7,351,006 B2 4/2008 Burnes et al.
7,364,384 B1 4/2008 Swistak
7,419,332 B1 * 9/2008 Brochu ..... E02B 11/005 405/49
7,465,122 B2 12/2008 Brochu et al.
2004/0013469 A1 * 1/2004 Hedstrom ..... E03F 1/003 138/155
2005/0074288 A1 * 4/2005 Moore, Jr. ..... E03F 1/003 405/46
2005/0111915 A1 * 5/2005 Moore, Jr. ..... E03F 1/003 405/49

* cited by examiner

*Primary Examiner* — Frederick L Lagman
*Assistant Examiner* — Stacy N Lawson
(74) *Attorney, Agent, or Firm* — Finnegan, Henderson, Farabow, Garrett & Dunner LLP

(57) ABSTRACT

A leaching chamber for implementation in a leaching field is provided. The leaching chamber may include a first end with a first end flange and a second end with a second end flange. The first end flange may be configured to overlap and rotatably connect with a complementary end flange of a second leaching chamber such that the leaching chamber is configured to rotate with respect to the second leaching chamber and to be disposed at a selected angular orientation relative to the second leaching chamber. A first locking feature on the first end flange may be configured to engage with a locking feature on the complementary end flange to lock the leaching chamber in the selected angular orientation relative to the second leaching chamber.

23 Claims, 6 Drawing Sheets

LEACHING CHAMBER WITH LOCKING SWIVEL LATCH

CROSS-REFERENCE TO RELATED APPLICATIONS

This application claims the benefit of U.S. Provisional Application Ser. No. 63/352,344, filed on Jun. 15, 2022, which is hereby incorporated by reference herein in its entirety.

TECHNICAL FIELD

Embodiments of the present disclosure relate generally to leaching chambers for receiving and dispersing wastewater and, more particularly, to a leaching chamber having a mechanism for locking a first leaching chamber to a second leaching chamber at a range of angular orientations.

BACKGROUND OF THE DISCLOSURE

Hollow plastic leaching chambers are commonly buried in the ground to form leaching fields for receiving and dispersing liquids such as sewage system effluent or storm water into the surrounding earth. Such leaching chambers typically have a central cavity for receiving liquids. An opening on the bottom and louvers on the sides provide the means through which liquids are allowed to exit the central cavity and disperse into the surrounding earth. Typically, such leaching chambers have mating opposing ends so that like chambers can be connected to each other end-to-end, in series, to achieve a desired subterranean volume and dispersion area. They are usually arch-shaped and corrugated with symmetrical corrugations for strength.

Sometimes, the nature of the terrain for a desired leach field installation requires that chambers be installed as non-straight rows. Similarly, efficient use of the land can be increased by having the chambers follow the natural contours of the land. In such situations, a bend in a string of chambers can be accomplished by use of chambers or adapters which have angled ends. More recent developments include swivel-end chambers, such as those disclosed in U.S. Pat. Nos. 6,592,293, 7,351,006 and 7,465,122. Such leaching chambers may, for example, include a swivel feature that allows such chambers to be angled out of alignment by up to 15°.

When trenches are not used, the chambers are placed on a leveled soil bed. This arrangement makes the chamber rows easy to adjust as desired. However, when these swivel-end chambers are buried, they can inadvertently be pushed out of alignment via rotation of one chamber relative to another about the swivel feature during the machine backfilling process. Inhibiting relative movement of the chambers during the backfilling process has largely required soil to be placed on the chambers (e.g., on the foot of such chambers) by hand labor to hold them in place prior to machine backfilling, and/or the use of external screws or fasteners to fix the relative position of two adjacent chambers. Either method, however, is tedious and increases the time and labor required for leach field installation. While certain chambers have been designed with deployable features that enable adjacent chambers to be at least temporarily maintained in a straight orientation, such as that disclosed in U.S. Pat. No. 7,364,384, they are not capable of being locked at an angle.

In view of the above, there is a need for a leaching chamber having a mechanism for locking a first leaching chamber to a second leaching chamber at a range of angles, without the need for auxiliary fasteners or initial backfilling by hand labor to prevent inadvertent relative movement of the chambers during machine backfilling.

SUMMARY

It is an object of the present disclosure to provide a leaching chamber.

It is another object of the present disclosure to provide a leaching chamber having a swivel feature that allows such chamber to be angled out of alignment with respect to an adjacent chamber.

It is another object of the present disclosure to provide a leaching chamber having a mechanism for locking a first leaching chamber to a second leaching chamber at a selected angular orientation.

These and other objects are achieved by the present disclosure.

Consistent with disclosed embodiments, systems, assemblies, apparatuses, and methods related to leaching chambers are disclosed. According to an embodiment of the present disclosure, a leaching chamber is provided. The leaching chamber may include a first end having a first end flange and a first locking feature associated with the first end flange; a second end having a second end flange and a second locking feature associated with the second end flange; and a chamber body between the first end and second end of the leaching chamber. The first end flange may be configured to overlap and rotatably connect with a complementary end flange of a second leaching chamber such that the leaching chamber is configured to rotate with respect to the second leaching chamber and to be disposed at a selected angular orientation relative to the second leaching chamber. The first locking feature of the first end flange of the leaching chamber may be configured to engage with a locking feature of the complementary end flange of the second leaching chamber to lock the leaching chamber in the selected angular orientation relative to the second leaching chamber.

According to embodiments of the present disclosure, a leaching field assembly is provided. The leaching field assembly may include a first leaching chamber including a first end having a first end flange, at least one locking pin depending from an underside of the first end flange, a second end having a second end flange, and a plurality of grooves on the second end flange; and a second leaching chamber including a first end having a first end flange, at least one locking pin depending from an underside of the first end flange, a second end having a second end flange, and a plurality of grooves on the second end flange. The first end flange of the second leaching chamber may be configured to overlap and rotatably connect with the second end flange of the first leaching chamber such that the second leaching chamber is configured to rotate with respect to the first leaching chamber and to be disposed in a selected angular orientation relative to the first leaching chamber. Each locking pin of the second leaching chamber may be configured to engage with one of the grooves of the first leaching chamber to lock the second leaching chamber in the selected angular orientation relative to the first leaching chamber.

According to embodiments of the present disclosure, a method of assembling a leaching field is provided. The method may include disposing a first leaching chamber on a surface, the first leaching chamber having a first end with a first end flange and a second end with a second end flange; overlapping a first end flange of a second leaching chamber with the second end flange of the first leaching chamber;

rotating the second leaching chamber with respect to the first leaching chamber to arrange the second leaching chamber in a selected angular orientation relative to the first leaching chamber; and pivoting the second leaching chamber to engage a first locking feature on the first end flange of the second leaching chamber with a corresponding second locking feature on the second end flange of the first leaching chamber to lock the second leaching chamber in the selected angular orientation with respect to the first leaching chamber.

The forgoing summary provides certain examples of disclosed embodiments to provide a flavor for this disclosure and is not intended to summarize all aspects of the disclosed embodiments. Additional features and advantages of the disclosed embodiments will be set forth in part in the description that follows, and in part will be apparent from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

BRIEF DESCRIPTION OF THE DRAWINGS

The accompanying drawings, which are incorporated in and constitute a part of this specification, illustrate disclosed embodiments and, together with the description, serve to explain the disclosed embodiments.

DETAILED DESCRIPTION

Figure 1:
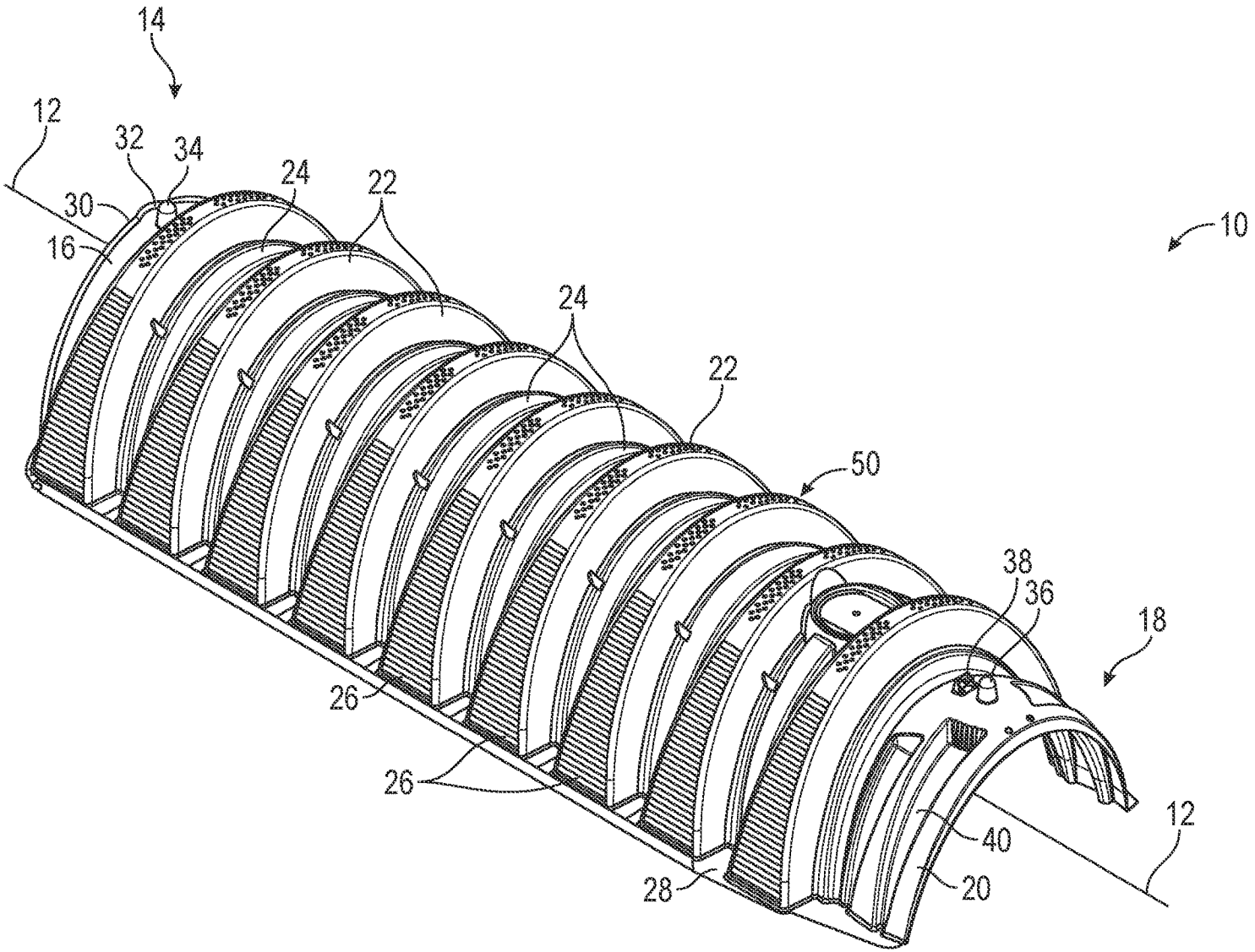
FIG. 1 is a perspective view of a leaching chamber according to embodiments of the present disclosure.

Examples of embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

As used herein, the phrases "for example," "such as," "for instance" and variants thereof describe non-limiting embodiments of the presently disclosed subject matter. Reference in the specification to features of "embodiments," "examples," "one case," "some cases," "other cases" or variants thereof means that a particular feature, structure or characteristic described may be included in at least one embodiment of the presently disclosed subject matter. Thus the appearance of such terms does not necessarily refer to the same embodiment(s). As used herein, the term "and/or" includes any and all combinations of one or more of the associated listed items. As used herein, the expression "at least one of . . . or" may include each listed item individually or any combination of the listed items. For example, the expression "at least one of A, B, or C" may include any of A, B, or C alone or any combination of A, B, and C (e.g., A+B, A+C, B+C, or A+B+C).

Features of the presently disclosed subject matter, are, for brevity, described in the context of particular embodiments. However, it is to be understood that features described in connection with one embodiment are also applicable to other embodiments. Likewise, features described in the context of a specific combination may be considered separate embodiments, either alone or in a context other than the specific combination.

Examples of the presently disclosed subject matter are not limited in application to the details of construction and the arrangement of the components set forth in the following description or illustrated in the drawings. The subject matter may be practiced or carried out in various ways. Also, it is to be understood that the phraseology and terminology employed herein is for the purpose of description and should not be regarded as limiting.

In this document, an element of a drawing that is not described within the scope of the drawing and is labeled with a numeral that has been described in a previous drawing may have the same use and description as in the previous drawings.

The drawings in this document may not be to any scale. Different figures may use different scales and different scales can be used even within the same drawing, for example different scales for different views of the same object or different scales for the two adjacent objects.

With reference to FIGS. 1-4, a leaching chamber 10 according to an embodiment of the present disclosure is illustrated. As shown therein, the leaching chamber 10 may include an open bottom and may be generally arch shaped with a central axis 12. The leaching chamber 10 includes a first end 14 having a first end flange 16, a second end 18 having a second end flange 20, and a chamber body 50 extending between the first end 14 and second end 18. In some embodiments, the first and second end flanges 16, 20 are complementary so that the first end flange 16 of one chamber can mate with the second end flange 20 of an adjacent chamber (i.e., a complementary end flange) to form a serial chain of chambers for a leaching field as understood by those of ordinary skill in the art. In particular, the ends of the leaching chamber can include end flanges that can be overlapped and locked with end flanges on adjacent leaching chambers, as described below.

Between the first and second end flanges 16, 20, the chamber body 50 may include a plurality of corrugations formed of alternating peaks 22 and valleys 24. The peaks 22 and valleys 24 may include respective sidewalls with louver features defining slotted openings 26 for dispersing effluent or storm water from inside the chamber 10, as is known in the art. Leaching chamber 10 may also include a base flange 28 configured to act as feet for the leaching chamber 10 so that when installed, the base flange 28 is set on the surface of a prepared trench.

With further reference to FIG. 1, in an embodiment, the first end flange 16 may include a lip 30 which runs along the arch shaped opening at the first end 14 of the chamber 10, a catch 32 defined by an outwardly flared portion of the lip 30, and a hollow molded, female-function pin 34 adjacent to the catch 32. For example, catch 32 may be disposed at the top, center portion of first end flange 16 (see FIG. 1). In disclosed embodiments, the second end flange 20 may include a male-function pin 36 adjacent to the second end 18 and a latch 38 adjacent to the male-function pin 36. For example, latch 38 may be disposed at the top, center portion of second end flange 20 (see FIG. 1) and may be separated from the second end 18 by the male-function pin 36 (i.e., pin 36 may be positioned in-between latch 38 and second end 18, along a direction of central axis 12). The configuration and function of the female-function and male-function pins 34, 36 and catch 32 and latch 38 are more specifically described in U.S. Pat. No. 7,465,122, which is hereby incorporated by reference in its entirety.

Figure 2:
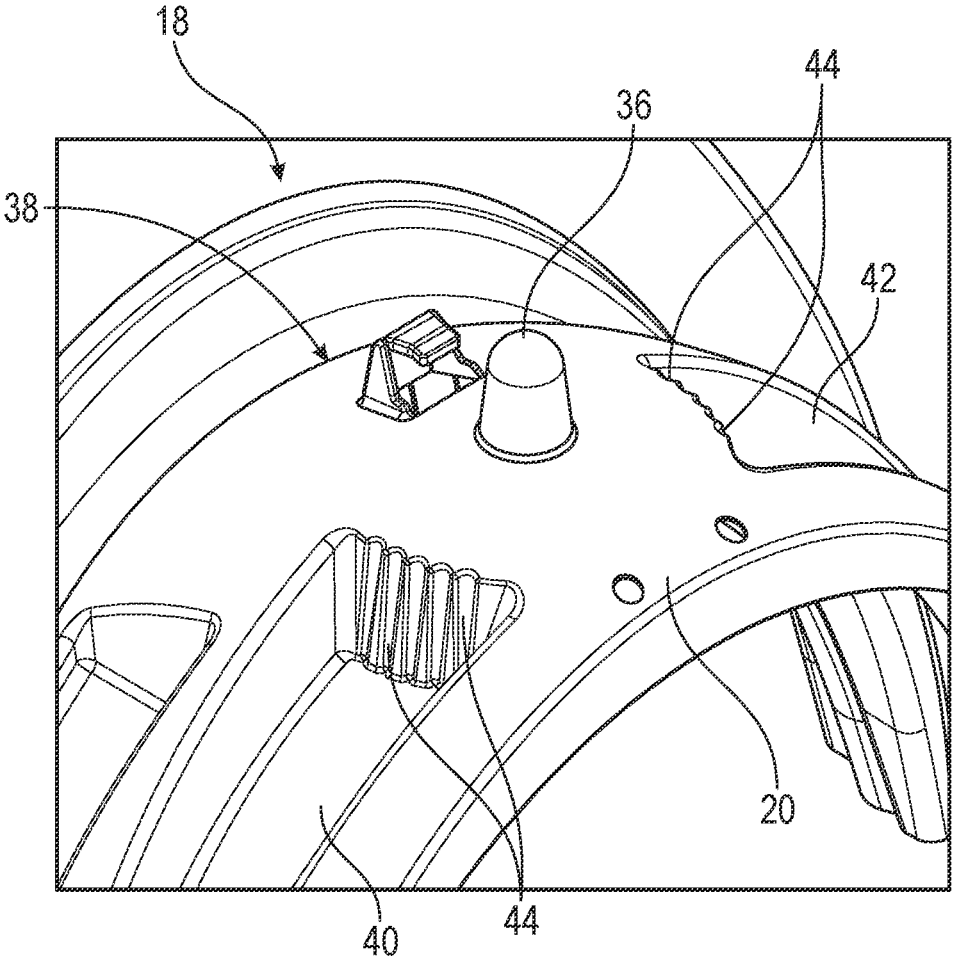
FIG. 2 is an enlarged, perspective view of a second end of the leaching chamber of FIG. 1, consistent with disclosed embodiments.
Figure 3:
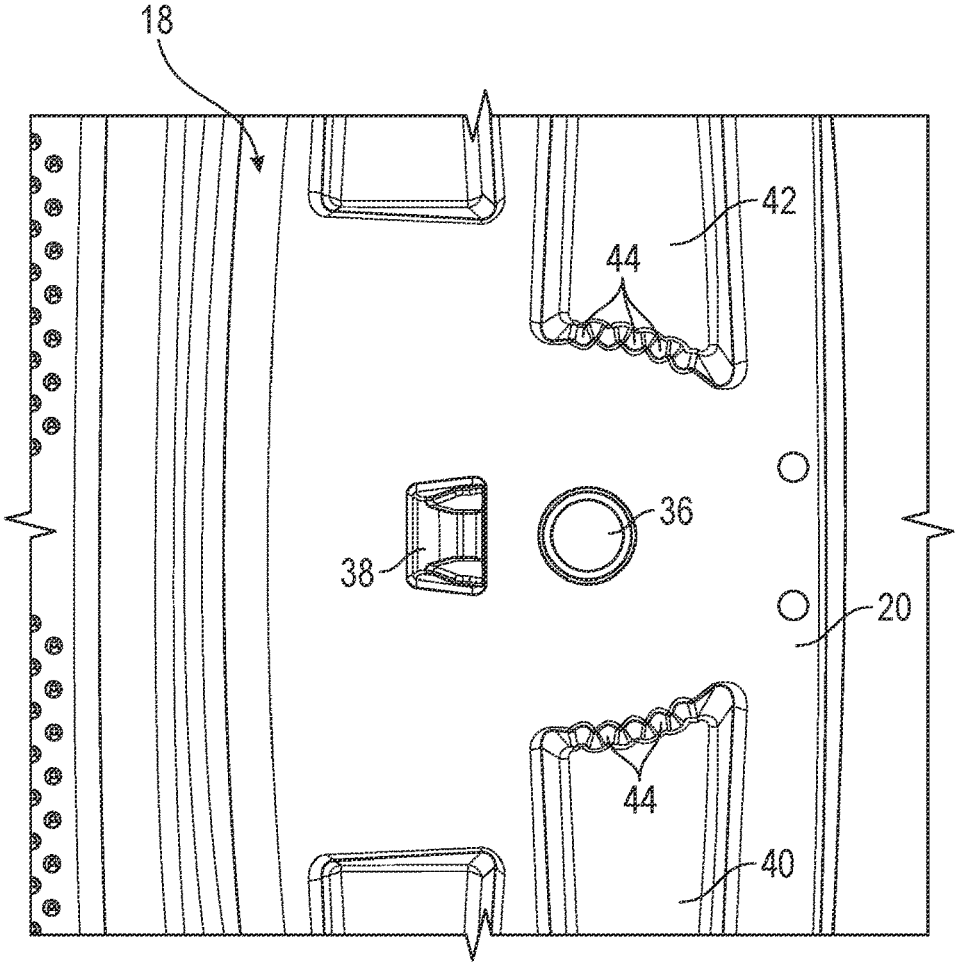
FIG. 3 is an enlarged, top plan view of the second end of the leaching chamber of FIG. 1, consistent with disclosed embodiments.

As best shown in FIGS. 2 and 3, the second end flange 20 may include a locking feature for securing the second end 18 of chamber 10 to another leaching chamber. In some embodiments, the locking feature of the second end flange 20 may include one or more female-function indentations or grooves configured to receive a corresponding male-structure locking feature of another leaching chamber. For example, second end flange 20 may include a pair of wells 40, 42 on opposing sides of the male-function pin 36, each having a plurality of gear teeth defining an array of vertical locking grooves 44 therebetween, the purpose of which will be described hereinafter; the arrays of vertical locking grooves 44 may be configured as the locking feature of second end flange 20. In disclosed embodiments, the arrays of grooves of each well 40, 42 may be arranged in an arc or curved array (e.g., arranged along a portion of a circumference of a circle). In disclosed embodiments, each array may include any suitable number of grooves 44 (e.g., two, three, four, five, six, seven, or any other suitable number of grooves).

Figure 4:
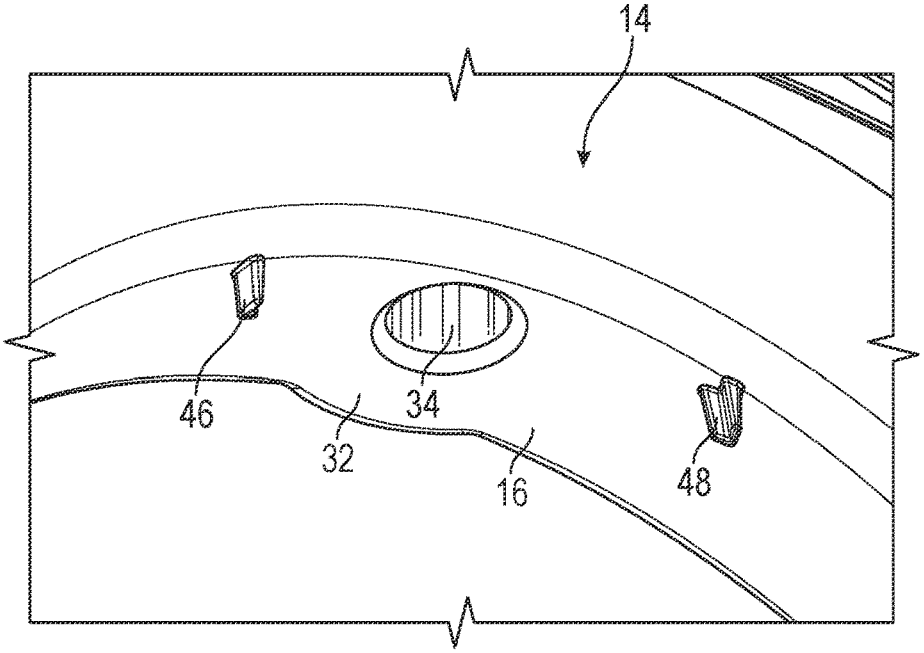
FIG. 4 is a bottom, perspective view of a first end of the leaching chamber of FIG. 1, consistent with disclosed embodiments.

Referring now to FIG. 4, the first end flange 16 may also include a locking feature for securing the first end 14 of chamber 10 to another leaching chamber. In some embodiments, the locking feature of the first end flange 16 may include one or more male-function structures (such as pins, pegs, or balls) configured to be received within a corresponding female-function structure of another leaching chamber. For example, an interior or underside surface of the first end flange 16 may include first and second depending legs or locking pins 46, 48 (also referred to herein as locking projections or locking pegs) on opposing sides of the female-function pin 34; locking pins 46, 48 may be configured as the locking feature of first end flange 16. In disclosed embodiments, the locking pins 46, 48 are generally L-shaped, although other shapes or configurations may also be employed without departing from the broader aspects of the present disclosure. For example, a pin having a simple cylindrical or square shaped cross-section may be utilized, although other cross-sectional shapes are possible. In disclosed embodiments, the pins 46, 48 may have a conical shape to facilitate insertion and engagement of the pins 46, 48 with corresponding grooves 44 of an adjacent leaching chamber. The locking pins 46, 48 may be spaced to either side of pin 34, and may be spaced apart from one another by a distance that is substantially equivalent to the distance between the array of grooves of each well 40, 42, and may be configured to interface or engage with the array of grooves 44 of an adjacent leaching chamber in the manner described hereinafter.

In alternative embodiments, the locking features of the first end flange 16 and second end flange 20 may include more or less than two (2) pairs of locking pins and groove arrays. For example, some alternative embodiments of leaching chamber 10 may include a single locking pin on the first end flange 16 and a single array of grooves on the second end flange 20, which may be configured to lock together in a similar manner as the locking pins 46, 48 with the arrays of grooves 44. In other alternative embodiments, the first end flange 16 may include three or more locking pins and the second end flange 20 may include the same number of corresponding arrays of grooves 44.

Figure 5:
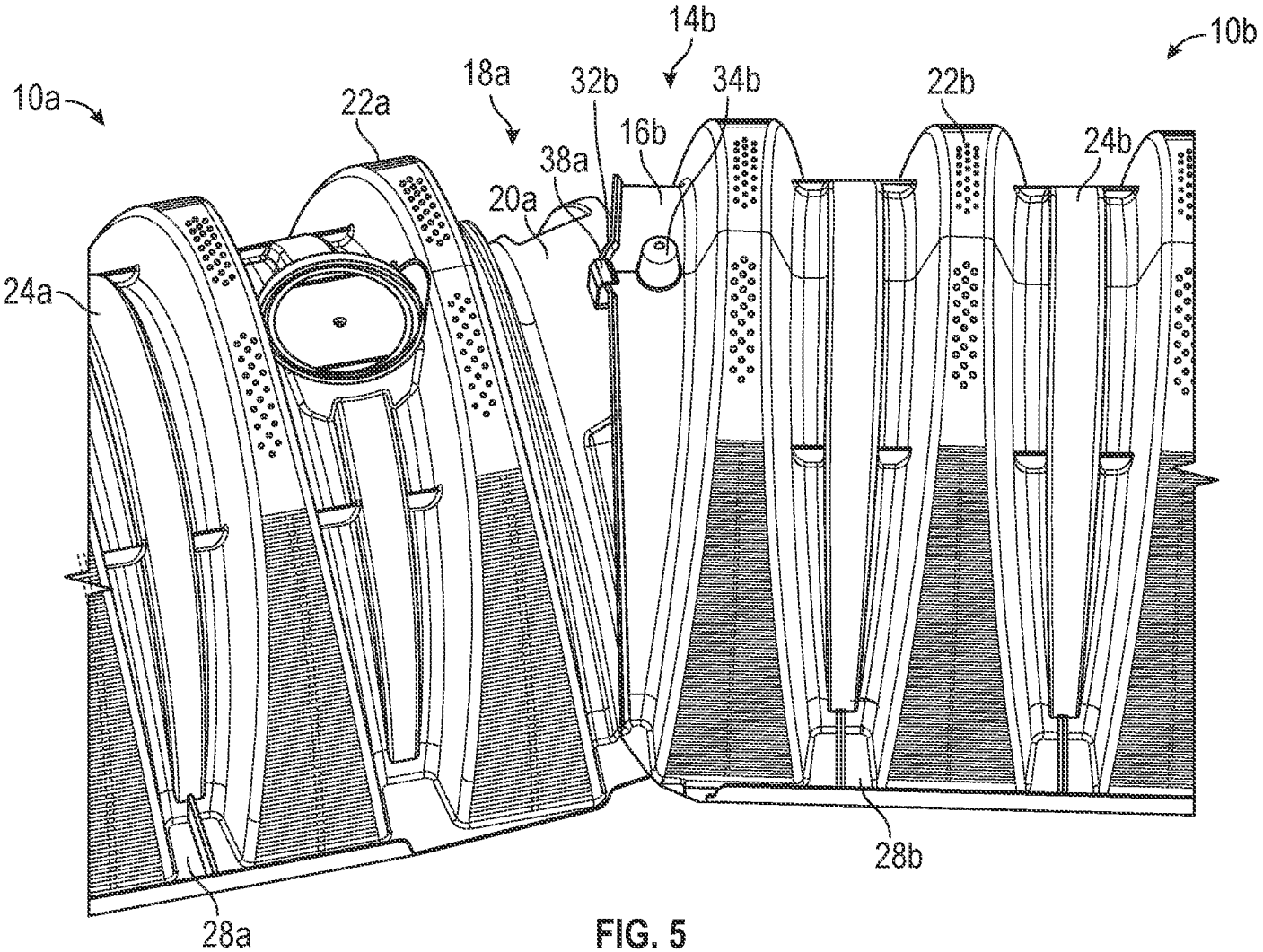
FIG. 5 is a perspective view illustrating the interconnection of adjacent leaching chambers of FIG. 1, consistent with disclosed embodiments.
Figure 6:
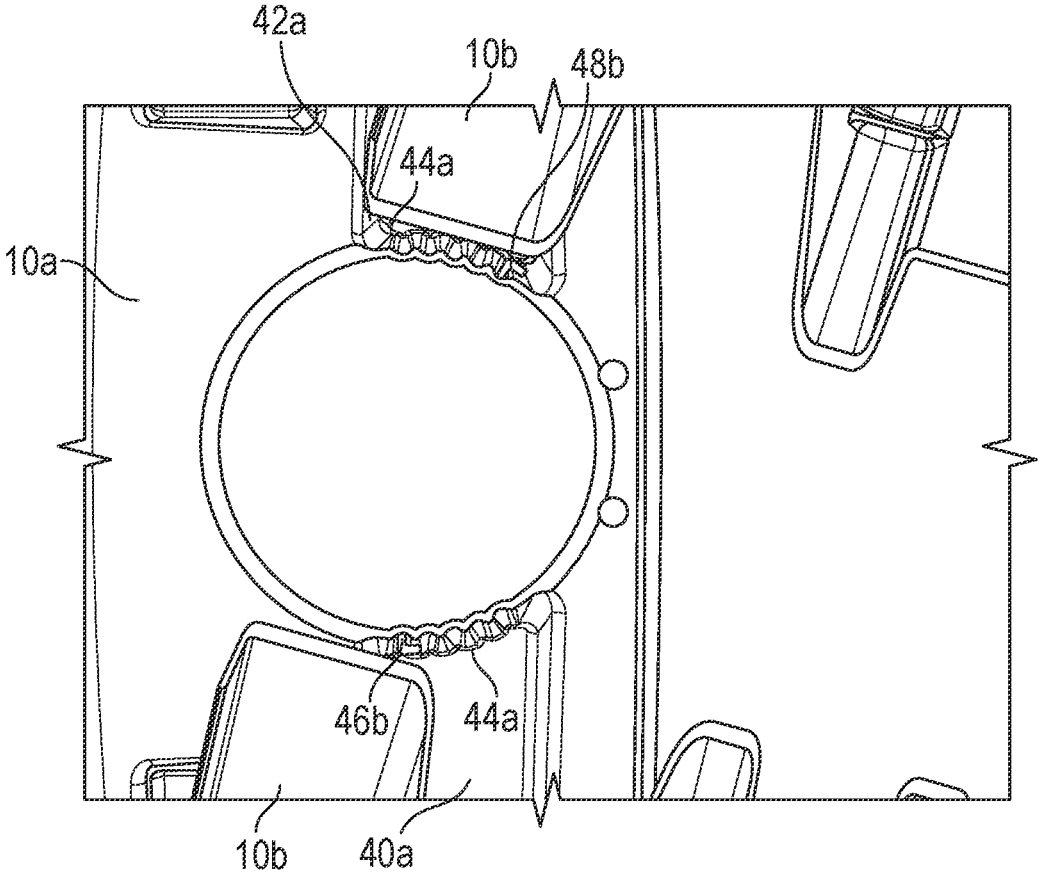
FIG. 6 is a partial cutaway, top plan illustrating the interconnection of adjacent leaching chambers of FIG. 1, consistent with disclosed embodiments.

FIGS. 5 and 6 illustrate the interconnection of two substantially identical leaching chambers 10*a* and 10*b*. As used herein, the term "substantially identical" may denote that the leaching chambers 10*a* and 10*b* each include respective first ends 14 that are identical in structure and/or in function and respective second ends 18 that are identical in structure and/or in function. In some embodiments, the term "substantially identical" may additionally denote that the leaching chambers 10*a* and 10*b* have identical chamber bodies 50 (e.g., that every portion of each chamber 10*a*, 10*b* is identical). In embodiments with three or more leaching chambers, two chambers or all three chambers may be substantially identical. While the term "substantially identical" is used herein, it is contemplated that certain variations may exist between the connected chambers. As shown, a first chamber 10*a* and a second chamber 10*b* (substantially identical to first chamber 10*a*, where like reference numerals indicate like parts) may be interconnect by overlapping complementary end flanges 16*b* and 20*a*. In particular, as is generally known in the art, first chamber 10*a* may be installed in place with its second end flange 20*a* exposed. The second chamber 10*b* may be installed by holding the second chamber 10*b* at an approximate 45 degree angle with respect to the ground, and placing its first end flange 16*b* over the second end flange 20*a* of the first chamber 10*a*, with the female-function pin 34*b* of the second chamber 10*b* aligned over the male-function pin 36*a* of the first chamber 10*a*. The second chamber 10*b* may then be pivoted (e.g., lowered toward the ground) until the male-function pin 36*a* on the second end flange 20*a* of the first chamber 10*a* is received within the recess defined by the female-function pin 34*b* on the first end flange 16*b* of the second chamber 10*b*.

At this point, while maintaining the first end 14*b* of the second chamber 10*b* in an elevated position (i.e., while maintaining the second chamber 10*b* at an approximate 45 degree angle with respect to the ground), the second chamber 10*b* may be selectively rotated horizontally about the male-function pin 36*a* of the first chamber 10*a* to arrange the second chamber 10*b* in a selected angular orientation relative to the first chamber 10*a*. That is, the second chamber

10*b* may be rotated until a desired angle is formed between the first chamber 10*a* and second chamber 10*b* (e.g., an angle between about zero degrees and about 15 degrees, where at zero degrees, the two connected chambers 10*a*, 10*b* are arranged in a straight line). This is possible because the locking pins 46*b*, 48*b* on the underside of the first end flange 16*b* of the second chamber 10*b* are not yet engaged with the corresponding arrays of grooves 44*a* in wells 40*a*, 42*a* of the first chamber 10*a* (due to the wells 40*a*, 42*a* being recessed with respect to the peripheral surface of the second end flange 20*a*). Thus, the first chamber 10*a* and second chamber 10*b* may be rotatably connected together. That is, the chambers may be connected together via female-function pin 34*b* and male-function pin 36*a*, with the second chamber 10*b* configured to rotate horizontally about the male-function pin 36*a* of the first chamber 10*a*.

When a selected angular orientation or angular offset of the second chamber 10*b* with respect to the first chamber 10*a* is achieved, the second end 14*b* of the second chamber 10*b* can be lowered to the ground. This movement causes the locking pins 46*b*, 48*b* of the second chamber 10*b* to engage with corresponding grooves 44*a* within wells 40*a*, 42*a* of the first chamber 10*a*. This interface inhibits and/or prevents additional relative rotational movement between the first and second chambers 10*a*, 10*b*, locking the chambers 10*a*, 10*b* in the selected orientation. In particular, any effort to rotate the second chamber 10*b*, such as when soil is dumped onto the first or second chamber during backfilling, will be inhibited by the locking pins 46*b*, 48*b* of the second chamber 10*b* contacting the gear teeth adjacent to the grooves 44*a* of the first chamber 10*a*, which prevents the chambers 10*a*, 10*b* from rotating about the male-function and female-function pin connection.

In embodiments of leaching chamber 10 shown in FIGS. 3 and 6, the gear teeth and arrays of grooves 44 of the first well 40 and the second well 42 may be arranged along respective arcs that are part of the circumference of a circle having male-function pin 36 at its center. Similarly, the locking pins 46, 48 may be located at a distance from the female-function pin 34 that is equivalent to the radius of such circle.

In the embodiment shown in FIG. 5, the latch 38*a* of the first chamber 10*a* may be shaped and configured to mutually engage with the catch 32*b* of the second chamber 10*b*, thus forming a connection between latch 38*a* and catch 32*b* when the chambers 10*a*, 10*b* are joined. For example, latch 38*a* may be shaped to extend over and clip onto the catch 32*b*. During rotation of second chamber 10*b* relative to first chamber 10*a*, catch 32*b* may be configured to move laterally (i.e., in a lateral direction relative to central axis 12) beneath the latch 38*a*, thus securing the rotatable connection formed by female-function pin 34*b* and male-function pin 36*a*.

In disclosed embodiments, the arrays of teeth within each well 40*a*, 42*a* may have a pitch or space between adjacent teeth (defining the grooves 44*a*) that corresponds to approximately 5 degrees of incremental angular offset between the connected chambers 10*a*, 10*b*. As a result, moving the locking pins 46*b*, 48*b* from engagement with a first pair of grooves 44*a* to an adjacent pair of grooves 44*a* may result in a plus or minus 5 degree rotation of the second chamber 10*b* with respect to the first chamber 10*a* (i.e., the angle between first chamber 10*a* and second chamber 10*b* changes by 5 degrees). Thus, once the second chamber 10*b* is rotated into the selected angular orientation (relative to first chamber 10*a*), the second end 14*b* of second chamber 10*b* may be pivoted (e.g., lowered toward the ground) so that locking pins 46*b*, 48*b* engage with the corresponding grooves 44*a* of the first chamber 10*a*. In an embodiment, the arrays of grooves 44*a* may be configured to allow for selective placement and locking of the second chamber 10*b* at an angle between about 0° and about 15°, at 5° lock position increments, with respect to the first chamber 10*a*.

While the arrays of grooves 44 and locking pins 46, 48 have been disclosed above as providing between 0° and 15° of swivel, it is not intended that the present disclosure be so limited in this regard. In particular, it is contemplated that the arrays of grooves 44 may have a larger or smaller arc length or diameter to provide for a range of potential angular orientations greater than or less than the range disclosed above. It is further envisioned that the arrays of grooves 44 and locking pins 46, 48 can be configured so that the angular orientation of the adjacent chambers can be adjusted in less than 5° increments, to provide an even finer degree over control over the leach field configuration. For example, it is contemplated that the pitch or space between adjacent grooves can be selected to provide an even finer degree of angular adjustment (that is, a greater number of lock positions).

Importantly, the engagement of the locking pins 46, 48 of one chamber (e.g., second chamber 10*b*) with the corresponding, complementary grooves 44 of the wells 40, 42 of an adjacent chamber (e.g., first chamber 10*a*) may inhibit or prevent relative rotational movement between the adjacent chambers, particularly during the machine backfilling process. This is in contrast to existing leaching chambers where tedious hand backfilling or screws have typically been necessary to prevent the chambers from being pushed out of the selected alignment during the burying process (as a result of soil from the loader pushing the chamber around its swivel features).

In addition to obviating the need for hand backfilling or screws to provide a locking mechanism of sorts, the configuration of the leaching chamber 10 of the present disclosure may allow for further adjustment of the angular orientation of the adjacent chambers at any point prior to burying. In particular, if the angular orientation needs to be adjusted after it is initially set, the second end 18*b* of the second chamber 10*b* can simply be lifted off the ground which, at a certain angle above the ground, will cause the locking pins 46*b*, 48*b* of second chamber 10*b* to disengage from the grooves 44*a* of first chamber 10*a*. With the male-function pin 36*a* of the first chamber 10*a* still engaged with the female-locking pin 34*b* of the second chamber 10*b*, the second chamber 10*b* is free to be rotated to a selected angular orientation. The second end 20*b* of the second chamber 10*b* can then again be pivoted, or lowered to the ground, to again cause the locking pins 46*b*, 48*b* of second chamber 10*b* to engage with the corresponding grooves 44*a* of first chamber 10*a* to lock the leaching chambers 10*a*, 10*b* in the selected orientation.

Once second chamber 10*b* is installed in the selected position with its second end flange 20*b* exposed, an additional leaching chamber (e.g., a third chamber, not pictured) may be similarly installed and connected to second chamber 10*b*. For example, a first end flange 16 of the third chamber may be placed over the second end flange 20*b* of the second chamber 10*b*; the third chamber may be rotated with respect to the second chamber 10*b* until a second selected angular orientation or angular offset is achieved between the chambers; and a second end 14 of the third chamber may be lowered so that locking pins 46, 48 of the third chamber may engage with corresponding grooves 44*b* within wells 40, 42 of the second chamber 10*b*. Additionally, or alternatively, a second end flange 20 of an additional leaching chamber (e.g., a third leaching chamber) may be similarly connected to the first end flange 16 of leaching chamber 10*a*. In some embodiments, the second selected angular orientation between the second and third chambers may be equal to or different from the first selected angular orientation between the first and second chambers. For example, the first and second selected angular orientations may be different to account for the topography of the ground beneath the leaching chambers. This process of connecting additional leaching chambers may be repeated to connect any suitable number of leaching chambers until a leaching field assembly of the desired size is achieved. Some or all of the leaching chambers in the field assembly may be substantially identical.

Figure 7:
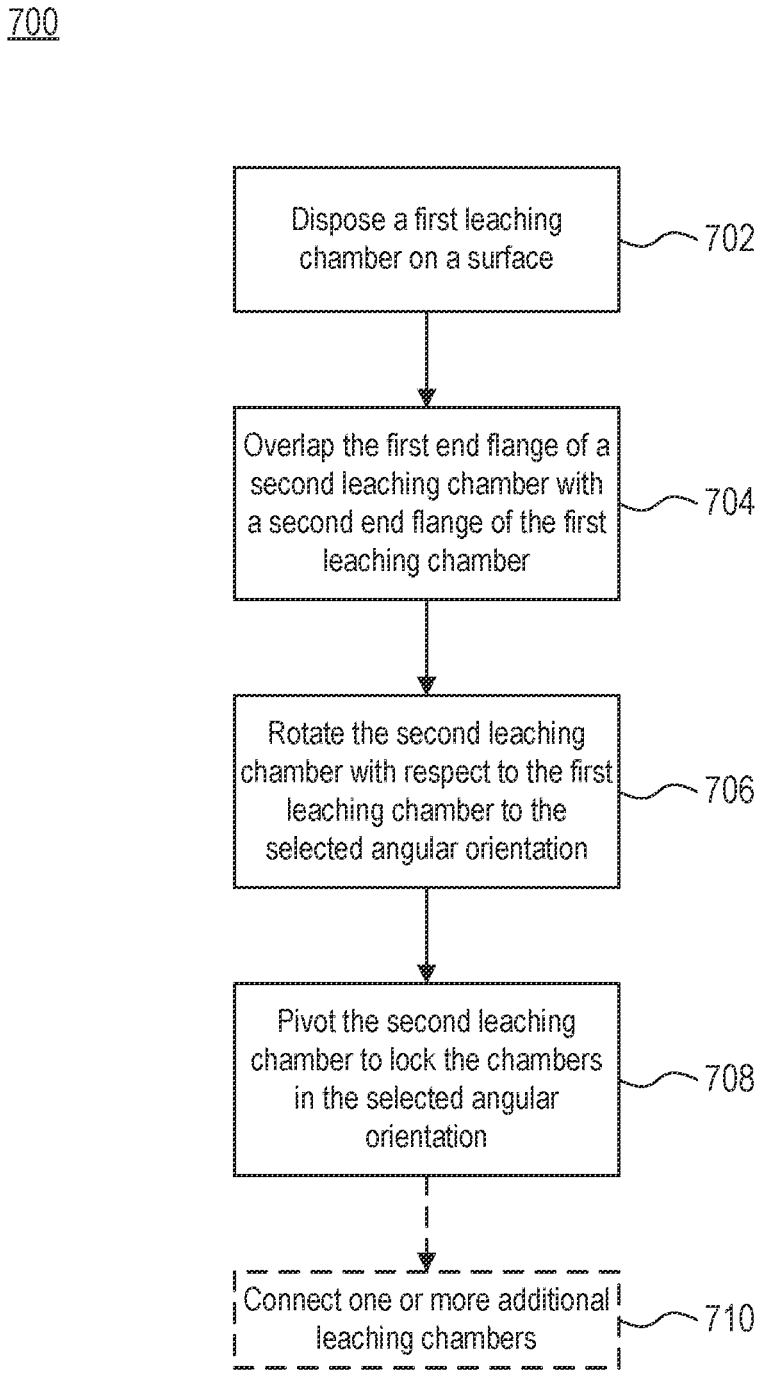
FIG. 7 is a flow chart illustrating an example of assembling a leaching field, consistent with disclosed embodiments.

FIG. 7 is a flowchart illustrating an example of a method 700 of assembling a leaching field. The leaching field may be formed from two or more leaching chambers. At step 702, method 700 may include disposing a first leaching chamber on a surface. The first leaching chamber may include a first end with a first end flange and a second end with a second end flange. As a non-limiting example, first chamber 10*a* shown in FIGS. 5 and 6 may correspond to the first leaching chamber in step 702. At step 704, method 700 may include overlapping a first end flange of a second leaching chamber with the second end flange of the first leaching chamber. For example, FIG. 5 depicts a first end flange 16*b* of a second chamber 10*b* overlapping a second end flange 20*a* of first chamber 10*a*. At step 706, method 700 may include rotating the second leaching chamber with respect to the first leaching chamber to arrange the second leaching chamber in a selected angular orientation relative to the first leaching chamber. In some embodiments, latch 38*a* of the first chamber 10*a* may mutually engage the catch 32*b* of the second chamber 10*b* during step 706.

At step 708, method 700 may include pivoting the second leaching chamber to engage a first locking feature on the first end flange of the second leaching chamber with a corresponding second locking feature on the second end flange of the first leaching chamber. In some embodiments, pivoting in step 708 may include lowering the second end 20*b* of second chamber 10*b* to or towards the ground. Due to the engagement of the first and second locking features, the second leaching chamber may be locked in the selected angular orientation with respect to the first leaching chamber. In some embodiments, the first locking feature may include depending pins 46, 48 shown in FIG. 4. Additionally, or alternatively, the first locking feature may include other structures. In some embodiments, the second locking feature may include the arrays of grooves 44 shown in FIGS. 2 and 3. Additionally, or alternatively, the second locking feature may include other structures.

At optional step 710, method 700 may include connecting one or more additional leaching chambers to the first leaching chamber or second leaching chamber. Any desired number of additional chambers may be added to the array of connected chambers until a leaching field of the desired size is formed.

The embodiments of the present disclosure described herein therefore provide a variety of means of achieving an angular offset between adjacent leaching chambers of a leaching field, and for fixing the chambers at the selected offset without requiring some degree of hand labor backfilling prior to machine backfilling. This allows for a more streamlined installation process and is in contrast to existing systems where hand backfilling has typically been required to inhibit substantial movement of the chambers relative to one another due to the large force of soil on the chambers created during the machine backfilling process.

In some embodiments, chambers of the present disclosure may be made of polyethylene, polypropylene or other olefin thermoplastic and may be made by injection molding. Chambers may be made by other processes and of other materials as well, without departing from the broader aspects of the present disclosure. For example, a chamber may be made by thermal forming or rotational molding or it may be made by an assembly of welded parts.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. While certain components have been described as being coupled to one another, such components may be integrated with one another or distributed in any suitable fashion.

Although this disclosure has been shown and described with respect to the detailed embodiments thereof, it will be understood by those of skill in the art that various changes may be made and that equivalents, modifications, omissions, combinations (e.g., of aspects across various embodiments), adaptations and/or alterations may be added to and/or substituted for elements thereof without departing from the scope of the disclosure. The elements in the claims are to be interpreted broadly based on the language employed in the claims and not limited to examples described in the present specification or during the prosecution of the application, which examples are to be construed as nonexclusive. In addition, modifications may be made to adapt a particular situation or material to the teachings of the disclosure without departing from the essential scope thereof. Further, the steps of the disclosed methods can be modified in any manner, including reordering steps and/or inserting or deleting steps. Therefore, it is intended that the scope of the appended claims not be limited to the particular embodiments disclosed in the above detailed description, but that the scope of the appended claims will include all embodiments falling within the scope of this disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A leaching chamber, comprising:

a first end of the leaching chamber having a first end flange and at least one locking pin associated with the first end flange;

a second end of the leaching chamber having a second end flange and at least one well having a plurality of gear teeth defining an array of locking grooves associated with the second end flange; and a chamber body between the first end and second end of the leaching chamber, wherein the first end flange is configured to overlap and rotatably connect with a complementary end flange of a second leaching chamber such that the leaching chamber is configured to rotate with respect to the second leaching chamber and to be disposed at a selected angular orientation relative to the second leaching chamber, and wherein the at least one locking pin of the first end flange of the leaching chamber is configured to engage with a locking groove of an array of locking grooves of the complementary end flange of the second leaching chamber to lock the leaching chamber in the selected angular orientation relative to the second leaching chamber.

2. The leaching chamber of claim 1, wherein:

the at least one locking pin depends from an underside of the first end flange.

3. The leaching chamber of claim 2, wherein the at least one locking pin of the first end flange comprises:

a first locking pin configured to engage a first array of locking grooves on the complementary end flange of the second leaching chamber; and a second locking pin configured to engage a second array of locking grooves on the complementary end flange.

4. The leaching chamber of claim 1, wherein the at least one well of the second end flange of the leaching chamber comprises a first well comprising a first array of locking grooves and a second well comprising a second array of locking grooves, the locking grooves of the second array being spaced apart from the locking grooves of the first array.

5. The leaching chamber of claim 4, wherein the first array of locking grooves and the second array of locking grooves are arranged along an arc that is part of a circumference of a circle.

6. The leaching chamber of claim 4, wherein the arrays of locking grooves are configured to engage with a locking pin of an adjacent leaching chamber to lock the leaching chamber in a plurality of angular orientations relative to the adjacent leaching chamber, the plurality of angular orientations varying by increments of approximately 5 degrees.

7. The leaching chamber of claim 4, wherein the arrays of locking grooves are configured to engage with a locking pin of an adjacent leaching chamber to lock the leaching chamber in a plurality of angular orientations relative to the adjacent leaching chamber, each angular orientation defining an angle between the leaching chamber and the adjacent leaching chamber that is between approximately 0 degrees and approximately 15 degrees.

8. The leaching chamber of claim 1, further comprising:

a catch disposed at a top portion of the first end of the leaching chamber, wherein the catch is configured to mutually engage with a latch disposed on the second leaching chamber to form a connection when the leaching chamber is joined to the second leaching chamber, wherein the catch is configured to move laterally beneath the latch during rotation of the leaching chamber relative to the second leaching chamber.

9. The leaching chamber of claim 1, further comprising:

a latch disposed at a top edge of the second end of the leaching chamber, wherein the latch is configured to mutually engage with a catch disposed on a third leaching chamber to form a connection when the leaching chamber is joined to the third leaching chamber, wherein the latch is configured to be disposed over the catch, and to permit lateral movement of the catch, during rotation of the leaching chamber relative to the third leaching chamber.

10. A leaching field assembly, comprising:

a first leaching chamber comprising a first end having a first end flange, at least one locking pin depending from an underside of the first end flange, a second end having a second end flange, and at least one well having a plurality of gear teeth defining an array of locking grooves on the second end flange; and a second leaching chamber comprising a first end having a first end flange, at least one locking pin depending from an underside of the first end flange, a second end having a second end flange, and at least one well having a plurality of gear teeth defining an array of locking a plurality of grooves on the second end flange, wherein the first end flange of the second leaching chamber is configured to overlap and rotatably connect with the second end flange of the first leaching chamber such that the second leaching chamber is configured to rotate with respect to the first leaching chamber and to be disposed in a selected angular orientation relative to the first leaching chamber, and wherein each locking pin of the second leaching chamber is configured to engage with a locking groove of the array of locking grooves of the first leaching chamber to lock the second leaching chamber in the selected angular orientation relative to the first leaching chamber.

11. The leaching field assembly of claim 10, further comprising:

a third leaching chamber comprising a first end having a first end flange, at least one locking pin depending from an underside of the first end flange, a second end having a second end flange, and at least one well having a plurality of gear teeth defining an array of locking grooves on the second end flange, wherein the first end flange of the third leaching chamber is configured to overlap and rotatably connect with the second end flange of the second leaching chamber such that the third leaching chamber is configured to rotate with respect to the second leaching chamber and to be disposed in a second selected angular orientation relative to the second leaching chamber, and wherein each locking pin of the third leaching chamber is configured to engage with a locking groove of the array of locking grooves of the second leaching chamber to lock the third leaching chamber in the second selected angular orientation relative to the second leaching chamber.

12. The leaching field assembly of claim 10, wherein the first leaching chamber is substantially identical to the second leaching chamber.

13. The leaching field assembly of claim 10, wherein:

the at least one well of the first leaching chamber includes a first well comprising a first array of locking grooves and a second well comprising a second array of locking grooves, the second array of locking grooves being spaced apart from the first array of locking grooves, and the at least one locking pin of the second leaching chamber includes a first locking pin configured to engage the first array of locking grooves, and a second locking pin configured to engage the second array of locking grooves.

14. The leaching field assembly of claim 13, wherein the first array of locking grooves and the second array of locking grooves are arranged in an arc.

15. The leaching field assembly of claim 10, wherein the at least one locking pin of the second leaching chamber and the array of locking grooves of the first leaching chamber are configured to lock the second leaching chamber in a plurality of angular orientations relative to the first leaching chamber, the plurality of angular orientations varying by increments of approximately 5 degrees.

16. The leaching field assembly of claim 10, wherein the at least one locking pin of the second leaching chamber and the array of locking grooves of the first leaching chamber are configured to lock the second leaching chamber in a plurality of angular orientations relative to the first leaching chamber, each angular orientation defining an angle between the first leaching chamber and the second leaching chamber that is between approximately 0 degrees and approximately 15 degrees.

17. The leaching field assembly of claim 10, further comprising:

a catch on a top portion of the first end flange of the second leaching chamber; and a latch on the second end flange of the first leaching chamber, wherein the latch and the catch are configured for mutual engagement to form a connection when the first leaching chamber is joined to the second leaching chamber, wherein the catch is configured to slide laterally beneath the latch during rotation of the second leaching chamber relative to the first leaching chamber.

18. A method of assembling a leaching field, comprising the steps of:

disposing a first leaching chamber on a surface, the first leaching chamber having a first end with a first end flange and a second end with a second end flange;

overlapping a first end flange of a second leaching chamber with the second end flange of the first leaching chamber;

rotating the second leaching chamber with respect to the first leaching chamber to arrange the second leaching chamber in a selected angular orientation relative to the first leaching chamber; and pivoting the second leaching chamber to engage at least one locking pin on the first end flange of the second leaching chamber with a corresponding well having a plurality of gear teeth defining an array of locking grooves on the second end flange of the first leaching chamber to lock the second leaching chamber in the selected angular orientation with respect to the first leaching chamber.

19. The method according to claim 18, wherein:

the at least one locking pin of the second leaching chamber includes at least one depending pin.

20. The method according to claim 18, wherein in the selected angular orientation, the second leaching chamber forms an angle with the first leaching chamber that is between approximately 0 degrees and approximately 15 degrees.

21. The method according to claim 18, wherein the first leaching chamber and the second leaching chamber are substantially identical.

22. The method according to claim 18, further comprising the step of:

receiving a projection provided on the second end flange of the first leaching chamber within a recess in the first end flange of the second leaching chamber.

23. The method according to claim 18, further comprising:

overlapping a first end flange of a third leaching chamber with a second end flange of the second leaching chamber;

rotating the third leaching chamber with respect to the second leaching chamber to arrange the third leaching chamber in a second selected angular orientation relative to the second leaching chamber; and pivoting the third leaching chamber to engage a first locking pin on the first end flange of the third leaching chamber with a corresponding second locking groove of an array of locking grooves on the second end flange of the second leaching chamber to lock the third leaching chamber in the second selected angular orientation relative to the second leaching chamber.

* * * * *